United States Patent [19]

Plancqueel et al.

[11] 4,274,940

[45] Jun. 23, 1981

[54] PROCESS FOR MAKING FERRO-NICKEL SHOT FOR ELECTROPLATING AND SHOT MADE THEREBY

[75] Inventors: Guy Plancqueel; Irme Toth, both of Rambouillet, France

[73] Assignee: Societe Metallurgique le Nickel -S.L.N., Paris, France

[21] Appl. No.: 50,095

[22] Filed: Jun. 19, 1979

Related U.S. Application Data

[63] Continuation-in-part of Ser. No. 974,447, Dec. 29, 1978, abandoned, which is a continuation of Ser. No. 713,432, Aug. 11, 1976, abandoned.

[30] Foreign Application Priority Data

Aug. 13, 1975 [FR] France ..... 75 25178

[51] Int. Cl.[3] ..... C25B 11/02; C25B 11/04; B22F 9/08

[52] U.S. Cl. ..... 204/294; 75/0.5 AA; 75/123 K; 75/170; 75/251; 204/43 T; 204/286; 204/293; 264/5; 264/11; 264/13

[58] Field of Search ..... 75/0.5 AA, 251, 170, 75/123 K; 204/43 T, 293, 294, 286; 264/11, 5, 13

[56] References Cited

U.S. PATENT DOCUMENTS

| | | | |
|---|---|---|---|
| 2,304,059 | 12/1942 | Bieber et al. | 204/293 |
| 2,863,790 | 12/1958 | Chen | 264/5 |
| 3,407,057 | 10/1968 | Timmons | 264/13 X |
| 3,428,442 | 2/1969 | Yurasko | 29/192 CP |

FOREIGN PATENT DOCUMENTS

| | | | |
|---|---|---|---|
| 938897 | 10/1948 | France | 264/13 |

OTHER PUBLICATIONS

R. J. Clauss et al., Plating, pp. 803–810, Aug. 1973.

C. T. Thomas et al., Trans. Am. Electrochem. Soc., vol. 45, pp. 193–218, (1924).

*Primary Examiner*—G. L. Kaplan

*Attorney, Agent, or Firm*—Fleit & Jacobson

[57] ABSTRACT

The invention provides a process for making ferro-nickel shot from a molten alloy bath including a granulating adjuvant containing silicon. The resulting shot can be used as soluble anodes for use in electroplating in which a ferro-nickel plating is applied to a substrate.

24 Claims, No Drawings

PROCESS FOR MAKING FERRO-NICKEL SHOT FOR ELECTROPLATING AND SHOT MADE THEREBY

The present invention is a continuation-in-part of patent application Ser. No. 974,447, filed Dec. 29, 1978 now abandoned, which is a continuation of patent application Ser. No. 713,432, filed Aug. 11, 1976, now abandoned.

The present invention has for its object a process for making shot of ferro-nickel for electroplating. It relates more particularly to the introduction of granulating adjuvants into the molten alloy bath from which the shot are made.

As is described in the commonly assigned U.S. Pat. No. 4,189,359, issued Feb. 19, 1980, in the names of Armand Limare and Guy Plancqueel, the use as soluble anode of anodic baskets, furnished with shot of ferro-nickel, is a considerable advance in the nickel-plating industry. However, while the techniques of making shot are well known, the particular case of making ferro-nickel shot has been hitherto little studied. This is why it has been necessary to devise a new process for making ferro-nickel shot and, more particularly, to find an adequate granulating adjuvant.

These shot must satisfy a number of very precise requirements: they should be easily manipulated, i.e., should flow easily whilst not rolling so as to be able to be made into perfectly spherical balls. On the other hand, they should have a high apparent density, which allows the easiest resolution of the problems of storage and best filling of the anodic baskets. Because of their use, these shot should have a chemical and structural homogeneity as high as possible. Chemical homogeneity is necessary to ensure a constant composition of the electrolyte, whilst structural homogeneity allows the avoidance of anodic dissolution along the preferential lines of attack. Thus a dissolution along the lines of grain boundaries could cause a breakdown of these latter and the precipitation of the grains in the form of a sediment before they are totally dissolved. Examples 1 to 3 (below) are a good illustration of the disadvantage brought about by shot which have serious structural heterogeneity.

Finally, the amount of impurities should be minimal. A distinction should, however, be drawn between two types of impurities, namely, those which, like silicon, are changed into insoluble particles and are precipitated as a sediment at the bottom of the electrolysis baths or of the anodic cells where the apparatus is fitted therewith, and the impurities which, like manganese, are dissolved and accumulate in the electrolyte so as to thus upset the proper working of the apparatus. While the first type of impurity is tolerable, the second should be minimized.

This is why an object of the invention is to provide a process of making ferro-nickel shot which flow easily and have a high apparent density.

Another object of the invention is to provide a process of making chemically and structurally homogeneous ferro-nickel shot.

A further object of the invention is to provide ferro-nickel shot suitable for use in the nickel-plating industry.

According to the invention, a process of making ferro-nickel shot suitable for electroplating comprises granulating a molten alloy in water, wherein a granulating adjuvant containing silicon is added to the initial molten alloy bath. The process comprises forming a molten bath of an alloy to which a granulating adjuvant has been added, and granulating the alloy in water. The shot so formed has a composition which is essentially the same as the molten alloy.

The temperature of the molten alloy bath should be from about 50° to about 150° C. higher than the melting point of the alloy, since the higher the temperature, the finer the size of the shot. Preferably, the alloy bath has a temperature of from about 90° to about 110° C. above the melting point of the alloy.

The granulating adjuvant can contain, in addition to silicon, some carbon and manganese; however, this latter has the major disadvantage that it accumulates in the electrolyte and can only be added in very small quantities.

For practical reasons, silicon is preferably introduced into the alloy bath in the form of ferro-silicon.

The choice of the amount of silicon to be introduced should be a compromise between two contradictory requirements. On the one hand, it is necessary that shot of suitable shape and chemical and structural homogeneity be obtained, which necessitates an increase in the proportion of silicon, and, on the other hand, it is required that the amount of sediment caused by the silicon be minimal.

The preferred compromise is to add an amount of silicon such that the final amount of silicon in the ferro-nickel shot is between 0.1 and 0.5% by weight.

The process of granulation in water which is used after the addition of silicon or carbon can be any such process of granulation which is known for metals other than ferro-nickel. Among the most suitable processes are those which consist in passing a thread of molten metal or alloy through a basket which is perforated at the bottom and optionally vibrated, or through a basket functioning by overflowing. That is, the shot is formed by passing a stream of molten metal from a tundish through a basket which is perforated at the bottom and, preferably, vibrated, with the molten alloy drops falling into a container filled with water which is maintained at room temperature (about 20°–25° C.). The distance between the bottom of the perforated basket and the surface of the water should be from about 20 to about 60 cm, preferably from about 30 to about 40 cm. The flow rate of the molten alloy into the water is from about 0.50 to about 2 metric ton per minute, preferably 1 metric ton per minute. There is also the process in which the jet of metal or alloy is broken up on a horizontal plate of the type described in German Pat. (published before examination) No. 2,211,682. In this case, the distance travelled by the molten alloy jet prior to hitting the horizontal plate is from about 20 to about 100 cm, preferably from about 40 to about 70 cm, and most preferably about 50 cm. Each of these processes should be adapted to suit ferro-nickel. The shot obtained should be of substantially spherical shape and have an apparent density of the order of 4 to 5 gm/cm$^3$. The mean diameter of the ferro-nickel shot should thus be, so far as possible, greater than the size of the meshes of the anodic baskets. Generally, they are of a mean diameter of the order of 1 cm, this last value being purely illustrative because it is very difficult to determine a diameter for a shot which is not perfectly spherical.

The structural and chemical homogeneity which is obtained by the process, according to the invention, is satisfactory, and one can note in the examples the differences which exist, from this point of view, between shot made with the aid of other granulating adjuvants and of shot made according to the invention.

In carrying out the process of preparing ferro-nickel shot suitable for electroplating, a molten mixture of a ferro-nickel alloy and a granulating adjuvant containing silicon and/or carbon is formed, and the mixture then granulated in water to obtain ferro-nickel shot which has a nickel content in the range of about from 20% to 90% by weight and a carbon content not exceeding about 0.2% by weight, which are of substantially spherical shape, which have a homogeneous structure, which are free of intergranular fissures, and which have an apparent density in the order of 4 to 5.

Preferably, the granulometry of the shot used for the process according to this invention should comply with the following conditions: at least 90% (in weight) of the shot being smaller than 25 mm. and at least 90% being larger than 5 mm.

To be suitable for electroplating, the shot structure should be either columnar or equiaxed without dendritic sub-structures due to inter-dendritic segregation; the grain boundary must be fine. The columnar structure is preferred. Its grain size (largest dimension) preferably ranges between 1 and 15 mm. These structural data are well consistent with the aforementionned hand-vise test, and, if the shot complies with it, the structure is sufficiently dendriteless. For a definition of columnar and equiaxed structures, reference is made to Metals Handbook, 8th Edition, Volumn 8, Mettallography, Structures and Phase Diagrams, published by the American Society for Metals, Metals Park, Ohio, page 144, and to A Concise Encyclopedia of Metallurgy by A. D. Merriman, Elsevi er Publishing Company, Amsterdam, 1965, page 121.

The maximum amount of the added adjuvants should be under 1% and, preferably, under 0.5%. The sum of the adjuvants must be higher than 0.1% and, preferably, higher than 0.15%, the best range being from 0.20% to 0.30%.

One can determine in advance if a batch of shot will give a significant amount of sediment with the aid of a simple hand-vise test. This test consists of evaluating the crushing resistance of a shot sample from the batch that it is desired to use by clamping the shot sample in a hand vise. If the shot sample is only slightly deformed, remains whole, and behaves like a ductile metal, then the batch of shot will give very little sediment. On the other hand, if the shot sample is deformed with crumbling, thus behaving like a brittle metal, the amount of sediment will be high unless the operating conditions are modified (for example, by using a high current density). A shot submitted to this hand-vise test which does not disintegrate when its larger diameter is decreased by $\frac{1}{3}$ presents a sediment rate of less than 1.5%. It may also be mentioned that the hand-vise test performed by an average person corresponds to a compression test (refered to hereinafter) of from 2 to 2.5 tons.

To be suitable for electroplating, the shot structure should be either columnar or equiaxed without dendritic sub-structures due to inter-dendritic segregation; the grain boundary must be fine. The columnar structure is preferred. Its grain size (largest dimension) preferably ranges between 1 and 15 mm. These structural data are well consistent with the aforementioned hand-vise test, and, if the shot complies with it, the structure is sufficiently dendriteless. For a definition of columnar and equiaxed structures, reference is made to Metals Handbook, 8th Edition, Volume 8, Metallography, Structures and Phase Diagrams, published by the American Society for Metals, Metals Park, Ohio, page 144, and to A Concise Encyclopedia of Metallurgy by A. D. Merriman, Elsevier Publishing Company, Amsterdam, 1965, page 121.

The best way to differentiate the shot of the present invention from other marketed ferro-nickels of the prior art is to describe its structure. In order to be suited for electroplating, as noted above, the structure of the ferro-nickel used must comply with the conditions described above, and no presently-marketed ferro-nickel, to the inventors' knowledge, complies with them.

To reveal the structure of a shot, Aqua Regia (ASTM E 407-70 N° 12) may be used. To reveal the substructures of the shot grains, the following reagent may be used:

400 ml HCl (density = 1.2 gm/ml)
8 g $CuCl_2$
28 g $FeCl_3$
20 ml $HNO_3$ (density = 1.4 gm/ml)
800 ml methanol
400 ml $H_2O$ This reagent is disclosed in the aforementioned A.S.M. Metals Handbook, Volume 7, in the Appendix.

A new test has been found which utilizes a compression device. If the shot is not disintegrated under a load of 5 metric tons, the sediment ratio will be under 1%, and, if the first fissuration appears at a value higher than 2 metric tons, the sediment ratio will be lower than 0.5%.

In carrying out this new compression test, a compression machine, e.g., INSTRON Model T.T.D.M. (as disclosed in Catalogue 1—1, entitled "Instron Machines et Material Modernes" d'essai des materiaux, published by Instron Limited, Halifax Road, High Wycombe, Bucks, England, pages 1-14) operating, for example, at a speed of about 5 mm/minute, and using a load, as for example, ranging from 0 to 10000 kg (0-10 metric tons), is employed to compress the shot sample, preferably of a size ranging between 1 and 1.5 mm.

The shot is compressed following the largest diameter direction. Two parallel flat areas of about 15 $mm^2$ are made by abrasion so that the stability of the shot between the two plates is ensured. The load is applied on the upper plate.

The above-described test allows one to obtain the shot deformation value $\Delta e$ ("e" for "epaisseur", i.e., thickness) as a function of the applied load in the form of a diagram. It also enables one to measure the load necessary for splitting and the load necessary for the appearance of the first fissuration.

This test is a very reliable way to predict the sediment ratio, and its use is disclosed in Example 35 of said commonly assigned U.S. Pat. No. 4,189,359.

In general, the shot of the present invention has the following composition:

| | Wt % | |
|---|---|---|
| | Useful | Preferred |
| Ni + Co/Ni + Co + Fe | 20 to 90% | 50 to 80% |
| Fe | 10 to 80% | 20 to 50% |
| Co/Ni + Co + Fe | 0 to 20% | 0 to 5% |
| Adjuvants | 0.1 to 1.0% | 0.2 to 0.3% |

To obtain a good shot, such as that described above, and using, as an example, a compression value of 0.5 metric ton on a shot complying with the afore-described structural conditions, the adjuvants added in the afore-described granulating process should be in the following ranges, all percentages being on a weight basis, unless specified otherwise.

To obtain a sediment ratio of less than 1%:
Si=0.01 to 0.5%
C=0.02 to 0.2%
Mg=0.01 to 0.4%
Mn=traces to 0.3%
Al=traces to 0.1%

To obtain a sediment ratio of less than 0.5%:
Si=0.04 to 0.2%
C=0.02 to 0.1%
Mg=0.04 to 0.1%
Mn=traces to 0.1%
Al=traces to 0.6%,
with "traces" amounting to less than 0.001%, and the sum total of the Mg+Mn+Al ranging between 0.05 and 0.20%.

In the case of ferro-nickels whereof ratio Ni+Co/-Ni+Co+Fe is comprised between 70 to 80% of nickel, the best ranges are:
Si=0.04 to 0.10%
C=0.02 to 0.05%
Mg=0.05 to 0.08%
Mn=traces
Al=traces In the case of ferro-nickels, whereof ratio Ni+Co/-Ni+Co+Fe is comprised between 50% to 69% of nickel, the best ranges are:
Si=0.10 to 0.20%
C=0.04 to 0.06%
Mg=0.06 to 0.08%
Mn=traces to 0.07%
Al=0.02 to 0.06%

As noted previously, the total amount of the adjuvants should be under 1% and, preferably, under 0.5%. The sum of the adjuvants must be higher than 0.1%, and preferably higher than 0.15%, the best range being from 0.20 to 0.30%.

The amounts of the other impurities present should, preferably, be under 0.20% in totality. More specifically, the amount of copper should be less than 0.03%, the amount of oxygen is preferably under 0.03%, and the amount of sulphur is under 0.02%.

The use of the ferro-nickel shot of the invention in electroplating ensures, moreover, a constant and uniform dissolution of the two metals (nickel and iron) with a Faraday anodic yield near to unity, which facilitates the control and maintenance of the iron-nickel ratio in the electrolyte and ensures a good versatility of operation in allowing stopping of the process without major difficulties. The dissolution of the alloy is complete and does not cause formation of a large amount of sediment.

The quality of the metal coating obtained by electrodeposition depends greatly on the ratio of ferric iron to the total amount of iron in the electrolyte. If this ratio is too high, the coating will contain ferric hydroxide, which appears as numerous specks of rust color. Thus, when the iron stabilizer is a complexing agent (as shown in the examples), this ferric iron ratio should not be more than 40%, and is preferably less than 20%.

It has been difficult to keep the ratio within the above limits, and, conventionally, such ratios are often near 50%. However, the simple fact of using shot of ferro-nickel of the present invention presents a solution to this problem by permitting one to obtain a ratio of ferric iron in the solution within the above-preferred limits, and, in many measurements of the ratio of ferric iron, none has exceeded 20%. The ratio of nickel to nickel plus iron (Ni/Ni+Fe) in the electrolyte bath ranges from about 20 to 90%, and, preferably, from about 40 to 80%.

Another factor influencing the quality of the cathodic coating is the cleanliness and the porosity of the anodic bags (sacs) surrounding the anodes which retain the sediment that otherwise would fall to the foot of the electrolytic tank. If these anodic cells are not changed frequently, the cathodic coating may have a very irregular thickness. This problem is particularly acute when small quantities of sulphur are added to the nickel anodes to facilitate dissolution. The present invention also presents a solution to this problem, since, when using the ferro-nickel shot, the anodic cells retain satisfactory porosity and cleanliness, and excellent cathodic coatings can be obtained without the necessity to change the anodic cells frequently.

Finally, the ferro-nickel shot are very soluble, and this high solubility avoids the necessity for using solubilizing agents and enables the quantity of chloride ions in the bath to be reduced to between 10 to 40 g/l.

It is interesting to note that none of the advantages described above are mentioned in the patents which allude to the possibility of using ferro-nickel. This, whatever its explanation, shows well the surprising results of the use of ferro-nickel in the form of shot.

The initial ferro-nickel can be prepared, e..g., by mixing, in suitable proportions, one of several ferro-nickels, such as, for example, the ferro-nickel sold under the trademark "SLN-FNI" (as described on pages 18–21 of a brochure published by the Societe Metallurgique Le Nickel-S.L.N., Tour Maine-Montparnasse, 33, av. du Maine 75751 PARIS CEDEX15, France) with pure nickel, such as the rondelles produced in the Le Havre factory of said Societe Metallurgique Le Nickel-S.L.N. It can also be prepared by a precise conversion of crude ferro-nickel in a manner so as to bring the iron/nickel ratio to the desired value.

So far as concerns the technique of electrode-position, one can refer to the aforementioned patent application, Serial No. 713,431, and to U.S. Pat. Nos. 3,795,591, 3,806,429, and 3,812,566 and to French Pat. No. 2,226,479.

The invention will now be illustrated by the following examples in which all percentages are by weight. Examples 1 to 3 are comparative, and show the disadvantages of shot which are not made according to the invention.

EXAMPLE 1

Ferro-nickel shot containing 77% nickel, which are hereinafter called "FN 77", were prepared from a liquid bath enriched with aluminium and magnesium (amounts introduced were 0.1% of Al and 0.1% of Mg, introduced in the form of a NiMg alloy containing 17.2% of Mg).

The shot had been made by means of a basket perforated with holes of diameter 4 mm.

The operating conditions were as follows
temperature of liquid metal: 1600° C.
height of fall into the water: 0.50 m The chemical analysis of the shot was as follows:
Ni=77.2%
Fe=21.9%

Co=0.38%
Si=0.008%
Mn=0.007%
C<0.002%
Mg=0.0002%
Al=0.004%

The shot had the following physical characteristics:
pseudo-spherical shape
uncompacted apparent density=5 gm/cm$^3$
flowability (determined by measuring the time taken for 10 kg of the product to flow through a hole 30 mm in diameter)=11 seconds.
size distribution:

| | | |
|---|---|---|
| diameter > 10 mm | = | 3.4% |
| 8–10 mm | = | 18.4% |
| 5–8 mm | = | 49% |
| 2.5–5 mm | = | 29.2% |

Solubility tests were carried out in a 12-liter tank in a bath of the following composition:

| | | | |
|---|---|---|---|
| $NiSO_4 . 6 H_2O$ = 75 g/l | | | |
| $NiCl_2 . 6 H_2O$ = 75 g/l | | | |
| $FeSO_4 . 7 H_2O$ = 10 g/l | | | |
| Commercial products of the Udylite Company: | | | |
| Brighteners | FN 1 | = | 25 cc/liter |
| | FN 2 | = | 2.5 cc/liter |
| | 84 | = | 18 cc/liter |
| Stabilizer | NF | = | 25 g/liter |
| Wetting Agent | 62A | = | 1 cc/liter |
| The operating conditions were: | | | |
| -anodic current density 10 Amps/dm$^2$ | | | |
| -pH = 3.7 | | | |
| -temperature (of bath) = 60° C. | | | |
| -length of test = 235 hours (corresponding to current quantity of 8694 Amp-hours). | | | |

The results were as follows:

After 83 hours of operation (i.e., after a current quantity of 3082 Amp-hours), a residue remained in the baskets and anodic cells consisting of metallic grains which were caused by a breakdown of the shot. The amount of residue corresponded to 4.4% of the shot consumed. At the end of the test (after 8694 Amp-hours) the amount of residue was 5.2%. The Faraday yield at the anode was near 1.

EXAMPLE 2

The same shot as in Example 1 were tested in the same type of bath, with a total anodic surface of 2 dm$^2$, but with an anodic current density of 3.8 Amps/dm$^2$ for 432 hours, corresponding to a current quantity of 3427 Amp-hours. The amount of residue was then 13%, and its chemical analysis showed the content of nickel and of iron to be close to that in the initial shot.

At the end of the test, the concentration of aluminium in the bath had increased from 4 to 13 mg/l without, however, having affected the plating.

EXAMPLE 3

Other shot of "FN 77" were prepared by the same technique but with an increased concentration of aluminium and magnesium.

The operating conditions were the same as indicated in Example 1.

The shot obtained had substantially the same physical properties as those described in Examples 1 and 2.

Chemical analysis of the shot gave the following results:
Ni=77.05%
Co=0.50%
Si=0.008%
Mn=0.013%
C=0.004%
Al=0.015%
Mg=0.002%
Fe=remainder The shot were then tested in the same type of bath as in the previous examples at an anodic current density of 2.7 Amps/dm$^2$ for 132 hours, corresponding to a current quantity of 1044 Amp-hours.

The amount of residue collected in the anodic baskets was then 15.6%.

A micrographic study showed the lack of structural homogeneity in the shot. The microphotographs showed the presence of micro-fissures which were of a sufficiently high number to cause breakdown in the grains by anodic dissolution or by mechanical crushing.

The following examples illustrate the present invention.

EXAMPLE 4

Another portion of shot was prepared from a bath of alloy to which silicon and manganese had been added.

The technique employed to obtain the shot referred to in this example consisted of breaking up the initial jet of molten metal on a horizontal plate placed 0.50 m from the outlet of the tap-hole and at 0.50 m from the level of the water.

The temperature of the liquid metal at the moment of the tapping was 1580° C.

Chemical analysis of these shot gave the following results:
Ni+Co=73.6%
Mn=0.27%
Si=0.16%
C=0.020%
Fe=to make 100

The shot were much more compact and mechanically resistant, and they did not show micro-fissures like the shot of Examples 1 to 3. Their mechanical resistance was excellent, and, unlike the shot referred to in the preceding examples, they did not crumble and resisted crushing.

These shot were tested in the same type of bath as the previous examples at an anodic current density of 2.5 Amps/dm$^2$ for 375 hours (total anodic surface 0.69 dm$^2$) for a total of 645 Amp-hours.

The residue obtained was very little (not measurable) and consisted of a blackish sediment containing silicon.

The concentration of manganese in the electrolyte rose from 0.028 g/liter to 0.162 g/liter at the end of the test.

The use in electrolysis of such shot necessitates very frequent replacement of electrolyte because of enrichment of manganese in the bath, because of which their use, although technically feasible, is bad and economically of little profit.

EXAMPLE 5

Another batch of shot was prepared according to the same technique as Example No. 4 from a bath enriched with carbon and silicon introduced in the form of ferrosilicon (amount of silicon introduced=0.5%).

The shot obtained were pseudo-spherical, compact and strong.

The uncompacted apparent density was 4.2, and the size distribution was as follows:

| | | |
|---|---|---|
| diameter 10–20 mm | = | 39% |
| 5–10 mm | = | 53% |
| <5 mm | = | 8% |

Chemical analysis of the shot gave the following results:

Ni+Co=76.85%
Co=1.25%
Si=0.20%
C=0.17%
Mn=0.05%
Fe=remainder

After testing at a current density of 2.4 Amps/dm$^2$ in the same type of bath as in the preceding examples, only a small residue was found after 200 hours of operation, i.e., after 942 Amp-hours of current.

EXAMPLE 6

Another batch of shot was made from a bath of alloy enriched with silicon and carbon according to the technique already described in Examples 4 and 5.

Chemical analysis gave the following results:

Ni=76%
Co=0.50%
Si=0.35%
C=0.10%
Mn=0.05%
Fe=remainder

A solubility test was carried out in a 100-liter tank in a bath having the following composition in g/l:

$NiSO_4$. 6 $H_2O$=105
$NiCl_2$. 6 $H_2O$=60
$FeSO_4$. 7 $H_2O$=10
$H_3BO_3$=45
Brighteners identical with those used in solubility tests 1 to 4 in Example 1.
Stabilizer C marketed by the Udylite Company.

The anodic current density was 3 Amps/dm$^2$, and the duration of the test was 330 hours corresponding to a current quantity of 5100 Amp-hours.

At the end of the test, the amount of residue was only 0.2% with respect to the amount of shot consumed.

Micrography of the shot tested in Examples 4 to 6 showed that their structure was homogeneous, and they did not have inter-granular fissures.

It will be clear to one skilled in the art that the amount of sediment obtained in Examples 2 and 3 was so highly unacceptable that it causes a serious loss of the starting material.

Examples 5 and 6 show how suitable the shot obtained by the process according to the invention are for electro-plating.

Although these examples relate to ferro-nickel in which the amount of nickel is from about 74 to 77%, it will be clear to those skilled in the art that this teaching is easily applicable to shot of various nickel contents (e.g., in the range 20 to 90% (by weight)).

The Brighteners FN 1, FN 2, and 84, Stabilizer NF, and Wetting Agent 62A, utilized in Examples 1 and 6 are products of The Udylite Company of Detroit, Michigan, a Division of Oxy Metal Finishing Corporation, and are conventionally used in electrolytic baths. These functions are described in The Udylite Technical Bulletin, issued September 17, 1973. The inventors have been advised by Officials of The Udylite Company that the compositions used in the examples correspond to the composition range described on page 8 of British Pat. No. 1,438,554, and that every brightener and stabilizer is also disclosed in ths British patent.

We claim:

1. A process of making ferro-nickel shot suitable for electroplating having a Ni+Co/Ni+Co+Fe ratio ranging from about 20 to 90% by weight, an Fe content ranging from about 10 to 80% by weight, a Co/Ni+Co+Fe ratio ranging from about 0 to 20% and containing a granulating adjuvant wherein about 99.8% by weight of said ferro-nickel shot consists essentially of iron, nickel, cobalt and said granulating adjuvant, comprising granulating in water a molten ferro-nickel alloy containing between 0.1 and 1% by weight of said granulating adjuvant containing silicon, carbon, magnesium, manganese and aluminum to thereby form said ferro-nickel shot, said ferro-nickel alloy containing from the granulating adjuvant about 0.01 to 0.5% silicon, about 0.02 to 0.2% carbon, about 0.01 to 0.4% magnesium, up to about 0.3% manganese, and up to about 0.1% aluminum.

2. A process as claimed in claim 1 wherein the granulating adjuvant includes ferro-silicon.

3. A process as claimed in claim 1 wherein the amount of silicon in the alloy ranges from 0.1 to 0.5% by weight.

4. The process as claimed in claim 1 wherein the starting ferro-nickel alloy is prepared by treating a crude ferro-nickel to convert the iron/nickel ratio to a value within the range of about from 0.10 to 3.95.

5. The process of claim 1 wherein the temperature of the molten alloy is from about 50° to about 150° C. higher than the melting point of the alloy.

6. The process of claim 5 wherein the granulating is conducted by passing a stream of molten alloy through a basket which is perforated at the bottom into a water bath maintained at a temperature of from about 20° to about 25° C., the temperature of the molten alloy being from about 50° to about 150° C. higher than the melting point of the alloy.

7. The process of claim 6 wherein the height of fall of the molten alloy into the water is from about 20 to about 60 cm.

8. The process of claim 5 wherein the granulating is conducted by breaking up a jet of molten alloy on a horizontal plate, the distance travelled by the jet before hitting the plate being from about 20 to about 100 cm.

9. The process of claim 1 wherein the flow rate of the molten alloy is from about 0.5 to about 2 metric tons per minute.

10. The process of claim 1 wherein the molten ferro-nickel alloy contains between 0.1 and 0.5% by weight of the granulating adjuvant.

11. The process of claim 1 wherein the molten ferro-nickel alloy contains between 0.20 and 0.30 % by weight of the granulating adjuvant.

12. Shot made by a process as claimed in claim 1.

13. The shot of claim 12 wherein the shot will withstand a compressive load of 5 metric tons without disintegrating.

14. A ferro-nickel shot which will withstand a compressive load of 5 metric tons without disintegrating, comprising by weight:

| | |
|---|---|
| Ni + Co/Ni + Co + Fe | 20 to 90% |
| Fe | 10 to 80% |
| Co/Ni + Co + Fe | 0 to 20% |
| Adjuvants | 0.1 to 1.0% |

wherein about 99.8% by weight of said ferro-nickel shot consists essentially of iron, nickel, cobalt and said adjuvants comprising silicon, carbon, magnesium, manganese and aluminum, said ferro-nickel shot containing from said adjuvants about 0.01 to 0.5% silicon, about 0.02 to 0.2% carbon, about 0.01 to 0.4% magnesium, up to about 0.3% manganese, and up to about 0.1% aluminum, said shot being prepared by forming a molten alloy having essentially the same composition of the shot, and granulating the alloy in water.

15. A process of making ferro-nickel shot suitable for electroplating having a Ni+Co/Ni+Co+Fe ratio ranging from about 20 to 90% by weight, and Fe content ranging from about 10 to 80% by weight, a Co/Ni+Co+Fe ratio ranging from about 0 to 20% and containing a granulating adjuvant wherein about 99.8% by weight of said ferro-nickel shot consists essentially of iron, nickel, cobalt and said granulating adjuvant, comprising granulating in water a molten ferro-nickel alloy containing between 0.1 and 1% by weight of said granulating adjuvant containing silicon, carbon, magnesium, manganese and aluminum to thereby form said ferro-nickel shot, said ferro-nickel alloy containing from the granulating adjuvant about 0.4 to 0.2% silicon, about 0.02 to 0.1% carbon, about 0.04 to 0.1% magnesium, up to about 0.1% manganese, and up to about 0.6% aluminum.

16. Shot made by a process as claimed in claim 15.

17. A process of making ferro-nickel shot suitable for electroplating having a Ni+Co/Ni+CO+Fe ratio ranging from about 70 to 80% by weight, an Fe content ranging from about 10 to 80% by weight, a Co/Ni+Co+Fe ratio ranging from about 0 to 20% and containing a granulating adjuvant wherein about 99.8% by weight of said ferro-nickel shot consists essentially of iron, nickel, cobalt and said granulating adjuvant, comprising granulating in water a molten ferro-nickel alloy containing between 0.1 and 1% by weight of said granulating adjuvant containing silicon, carbon, magnesium, manganese and aluminum to thereby form said ferro-nickel shot, said ferro-nickel alloy containing from the granulating adjuvant about 0.04 to 0.1% silicon, about 0.02 to 0.05% carbon and about 0.05 to 0.8% magnesium.

18. Shot made by a process as claimed in claim 17.

19. A process of making ferro-nickel shot suitable for electroplating having a Ni+Co/Ni+Co+Fe ratio ranging from about 50 to 69% by weight, an Fe content ranging from about 10 to 80% by weight, a Co/Ni+Co+Fe ratio ranging from about 0 to 20% and containing a granulating adjuvant wherein about 99.8% by weight of said ferro-nickel shot consists essentially of iron, nickel, cobalt and said granulating adjuvant, comprising granulating in water a molten ferro-nickel alloy containing between 0.1 and 1% by weight of said granulating adjuvant containing silicon, carbon, magnesium, manganese and aluminum to thereby form said ferro-nickel shot, said ferro-nickel alloy containing from the granulating adjuvant about 0.1 to 0.2% silicon, about 0.04 to 0.6% carbon, about 0.06 to 0.08% magnesium, up to about 0.07% manganese, and about 0.02 to 0.06% aluminum.

20. Shot made by a process as claimed in claim 19.

21. A process of making ferro-nickel shot suitable for electroplating having a Ni+Co/Ni+Co+Fe ratio ranging from about 20 to 90% by weight, an Fe content ranging from about 10 to 80% by weight, a Co/Ni+Co+Fe ratio ranging from about 0 to 20% and containing a granulating adjuvant wherein about 99.8% by weight of said ferro-nickel shot consists essentially of iron, nickel, cobalt and said granulating adjuvant, comprising granulating in water a molten ferro-nickel alloy containing between 0.1 and 0.5% by weight of said granulating adjuvant containing silicon, carbon, magnesium, manganese and aluminum to thereby form said ferro-nickel shot, said ferro-nickel alloy containing from the granulating adjuvant about 0.01 to 0.5% silicon, about 0.02 to 0.2% carbon, about 0.01 to 0.4% magnesium, up to about 0.3% manganese, and up to about 0.1% aluminum.

22. The process of claim 21 wherein the molten ferro-nickel alloy contains between 0.20 and 0.30% by weight of the granulating adjuvant.

23. A process of making ferro-nickel shot suitable for electroplating having a Ni+Co/Ni+Co+Fe ratio ranging from about 20 to 90% by weight, an Fe content ranging from about 10 to 80% by weight, a Co/Ni+Co+Fe ratio ranging from about 0 to 20% and containing a granulating adjuvant wherein about 99.8% by weight of said ferro-nickel shot consists essentially of iron, nickel, cobalt and said granulating adjuvant, comprising granulating in water a molten ferro-nickel alloy containing between 0.1 and 1% by weight of said granulating adjuvant containing silicon, carbon, magnesium, manganese and aluminum to thereby form said ferro-nickel shot, said ferro-nickel alloy containing from the granulating adjuvant about 0.01 to 0.5% silicon, about 0.02 to 0.2% carbon, about 0.01 to 0.4% magnesium, up to about 0.3% manganese, up to about 0.1% aluminum, and less than about 0.20% of other elements.

24. The process of claim 23 in which the other impurities include less than about 0.03% copper, less than about 0.03% oxygen, and less than about 0.02% sulphur.

* * * * *